US010073410B1

(12) United States Patent
Bacon et al.

(10) Patent No.: US 10,073,410 B1
(45) Date of Patent: Sep. 11, 2018

(54) IMAGING UNIT HAVING POSITIONING FEATURES FOR ELECTRICAL CONTACTS FOR USE IN AN ELECTROPHOTOGRAPHIC IMAGE FORMING DEVICE

(71) Applicant: LEXMARK INTERNATIONAL, INC., Lexington, KY (US)

(72) Inventors: Joe Carlo Enoc Bacon, Kidapawan (PH); Katrina Rosit Lactuan, Consolacion (PH)

(73) Assignee: Lexmark International, Inc., Lexington, KY (US)

( * ) Notice: Subject to any disclaimer, the term of this patent is extended or adjusted under 35 U.S.C. 154(b) by 0 days.

(21) Appl. No.: 15/722,087

(22) Filed: Oct. 2, 2017

Related U.S. Application Data

(60) Provisional application No. 62/504,733, filed on May 11, 2017.

(51) Int. Cl.
*G03G 21/18* (2006.01)
*G03G 15/08* (2006.01)

(52) U.S. Cl.
CPC ..... *G03G 21/1821* (2013.01); *G03G 15/0896* (2013.01); *G03G 21/1842* (2013.01); *G03G 21/1867* (2013.01); *G03G 2221/1853* (2013.01); *G03G 2221/1861* (2013.01)

(58) Field of Classification Search
CPC ..... G03G 2221/1853; G03G 2221/1861
See application file for complete search history.

(56) References Cited

U.S. PATENT DOCUMENTS

| | | | |
|---|---|---|---|
| 4,824,388 | A | 4/1989 | Pickel |
| 4,839,691 | A | 6/1989 | Tagawa et al. |
| 4,891,017 | A | 1/1990 | Kuhn et al. |
| 5,002,497 | A | 3/1991 | Plocek et al. |
| 5,259,779 | A | 11/1993 | Ooya et al. |

(Continued)

FOREIGN PATENT DOCUMENTS

| | | | |
|---|---|---|---|
| CN | 1841231 | A | 10/2006 |
| CN | 102262387 | A | 11/2011 |

(Continued)

OTHER PUBLICATIONS

U.S. Appl. No. 15/722,092, filed Oct. 2, 2017 (Bacon et al.).

*Primary Examiner* — Victor Verbitsky
(74) *Attorney, Agent, or Firm* — Justin M. Tromp

(57) ABSTRACT

A replaceable imaging unit for an electrophotographic image forming device includes an electrical contact positioned within a pocket of an electrical connector of the imaging unit that has an opening facing toward the front of a housing of the imaging unit to permit a corresponding electrical connector of the image forming device to enter the pocket and contact the electrical contact when the replaceable imaging unit is installed in the image forming device. A guide wall on a first side of the housing is spaced toward the front of the housing from the opening of the pocket of the electrical connector. The guide wall is unobstructed to contact the corresponding electrical connector of the image forming device during insertion of the replaceable imaging unit into the image forming device for aligning the corresponding electrical connector of the image forming device along a vertical dimension of the housing.

14 Claims, 12 Drawing Sheets

(56) References Cited

U.S. PATENT DOCUMENTS

| | | | |
|---|---|---|---|
| 5,392,371 | A | 2/1995 | Morlion et al. |
| 5,490,802 | A | 2/1996 | Plyler et al. |
| 5,605,150 | A | 2/1997 | Radons et al. |
| 5,746,617 | A | 5/1998 | Porter, Jr. et al. |
| 5,937,239 | A | 8/1999 | Watanabe et al. |
| 5,946,531 | A | 8/1999 | Miura et al. |
| 5,997,329 | A | 12/1999 | Kosmala |
| 6,014,533 | A | 1/2000 | Kawana |
| 6,014,536 | A | 1/2000 | Ban et al. |
| 6,097,908 | A | 8/2000 | Uchiyama et al. |
| 6,168,262 | B1 | 1/2001 | Clark et al. |
| 6,186,809 | B1 | 2/2001 | Kung |
| 6,254,408 | B1 | 7/2001 | Hattori et al. |
| 6,349,182 | B2 | 2/2002 | Otsubo et al. |
| 6,386,899 | B1 | 5/2002 | Ushio et al. |
| 6,502,917 | B1 | 1/2003 | Shinada et al. |
| 6,582,039 | B2 | 6/2003 | Johnson et al. |
| 6,652,309 | B2 | 11/2003 | Sukagawa |
| 6,773,283 | B2 | 8/2004 | Yoshimatsu et al. |
| 6,786,750 | B2 | 9/2004 | Itoh |
| 6,848,925 | B2 | 2/2005 | Nishide |
| 7,074,084 | B2 | 7/2006 | Shuey et al. |
| 7,086,872 | B2 | 8/2006 | Myer et al. |
| 7,258,558 | B1 | 8/2007 | Dawson et al. |
| 7,272,336 | B1 | 9/2007 | Dawson et al. |
| 7,831,168 | B2 | 11/2010 | Allen et al. |
| 8,200,126 | B2 | 6/2012 | Chaudhuri et al. |
| 8,867,966 | B2 | 10/2014 | Acosta et al. |
| 8,867,970 | B2 | 10/2014 | Acosta et al. |
| 8,879,953 | B2 | 11/2014 | Amann et al. |
| 8,938,179 | B2 | 1/2015 | Amann et al. |
| 9,046,868 | B2 | 6/2015 | Pezdek et al. |
| 9,170,559 | B2 | 10/2015 | Amann et al. |
| 9,360,834 | B1 | 6/2016 | Payne et al. |
| 9,429,899 | B2 | 8/2016 | Amann et al. |
| 9,482,989 | B1 | 11/2016 | Payne et al. |
| 9,563,169 | B1 | 2/2017 | Carpenter et al. |
| 2002/0025725 | A1 | 2/2002 | Ushio et al. |
| 2002/0057319 | A1 | 5/2002 | Saruta et al. |
| 2003/0035016 | A1 | 2/2003 | Tanaka |
| 2003/0118367 | A1 | 6/2003 | Omata et al. |
| 2003/0123896 | A1 | 7/2003 | Goto et al. |
| 2003/0215261 | A1 | 11/2003 | Karakama et al. |
| 2003/0223775 | A1 | 12/2003 | Yoshino et al. |
| 2005/0135838 | A1 | 6/2005 | Miller |
| 2006/0067725 | A1 | 3/2006 | Miyabe et al. |
| 2006/0103701 | A1 | 5/2006 | Chan |
| 2007/0086806 | A1 | 4/2007 | Burchette et al. |
| 2007/0098437 | A1 | 5/2007 | Kaiga |
| 2007/0230999 | A1 | 10/2007 | Shimomura |
| 2008/0159772 | A1 | 7/2008 | Koishi et al. |
| 2009/0196647 | A1 | 8/2009 | Nishimoto |
| 2010/0104312 | A1 | 4/2010 | Kawai et al. |
| 2010/0221039 | A1 | 9/2010 | Kawai et al. |
| 2013/0170867 | A1* | 7/2013 | Acosta ..... G03G 15/0886 399/258 |
| 2013/0170868 | A1* | 7/2013 | Acosta ..... G03G 15/0886 399/258 |
| 2014/0169824 | A1 | 6/2014 | Seto et al. |
| 2017/0205752 | A1 | 7/2017 | Amann et al. |

FOREIGN PATENT DOCUMENTS

| | | | |
|---|---|---|---|
| EP | 1411598 | A2 | 4/2004 |
| JP | 2005195884 | A | 7/2005 |
| JP | 2010020219 | A | 1/2010 |
| WO | 2011155642 | A1 | 12/2011 |

* cited by examiner

IMAGING UNIT HAVING POSITIONING FEATURES FOR ELECTRICAL CONTACTS FOR USE IN AN ELECTROPHOTOGRAPHIC IMAGE FORMING DEVICE

CROSS REFERENCES TO RELATED APPLICATIONS

This application claims priority to U.S. Provisional Patent Application Ser. No. 62/504,733, filed May 11, 2017, entitled "Positioning Features For Electrical Contacts of a Replaceable Unit of an Electrophotographic Image Forming Device," the content of which is hereby incorporated by reference in its entirety.

BACKGROUND

1. Field of the Disclosure

The present disclosure relates generally to image forming devices and more particularly to an imaging unit having positioning features for electrical contacts for use in an electrophotographic image forming device.

2. Description of the Related Art

In order to reduce the premature replacement of components traditionally housed in a toner cartridge of an electrophotographic image forming device, toner cartridge manufacturers have begun to separate components having a longer life from those having a shorter life into separate replaceable units. Relatively longer life components, such as a photoconductive drum, a cleaner blade/roll, a charge roll and a developer roll, are positioned in one replaceable unit, which may be referred to as an imaging unit. The image forming device's toner supply, which is consumed relatively quickly in comparison with the components housed in the imaging unit, is provided in a reservoir in a separate replaceable unit in the form of a toner cartridge that feeds toner to the imaging unit.

It is desired to communicate various operating parameters and usage information of the replaceable units to the image forming device for proper operation. For example, it may be desired to communicate such information as replaceable unit serial number, replaceable unit type, toner color, toner capacity, amount of toner remaining, license information, etc. The replaceable units typically include processing circuitry configured to communicate with and respond to commands from a controller in the image forming device. The replaceable units also include memory associated with the processing circuitry that stores program instructions and information related to the replaceable unit. The processing circuitry and associated memory are typically mounted on a circuit board that is attached to the replaceable unit. The replaceable unit also includes one or more electrical contacts that mate with corresponding electrical contacts in the image forming device upon installation of the replaceable unit in the image forming device in order to facilitate communication between the processing circuitry of the replaceable unit and the controller of the image forming device. It is important to accurately position the electrical contacts of the replaceable unit relative to the corresponding electrical contacts of the image forming device in order to ensure a reliable connection between the processing circuitry of the replaceable unit and the controller of the image forming device when the replaceable unit is installed in the image forming device.

Accordingly, positioning features that provide precise alignment of the electrical contacts of the replaceable unit with corresponding electrical contacts of the image forming device are desired.

SUMMARY

A replaceable imaging unit for use in an electrophotographic image forming device according to one example embodiment includes a housing having a top, a bottom, a front and a rear positioned between a first side and a second side of the housing. The housing includes a photoconductor unit positioned at the front of the housing. The photoconductor unit includes a rotatable photoconductive drum having a rotational axis that extends from the first side of the housing to the second side of the housing. A developer unit is positioned rearward from the photoconductor unit. The developer unit includes a reservoir for storing toner and a rotatable developer roll positioned to transfer toner from the reservoir to the photoconductive drum. An electrical connector is positioned on the photoconductor unit on the first side of the housing. The electrical connector includes an electrical contact positioned within a pocket of the electrical connector that has an opening facing toward the front of the housing to permit a corresponding electrical connector of the image forming device to enter the pocket and contact the electrical contact when the replaceable imaging unit is installed in the image forming device. A guide wall on the first side of the housing is spaced toward the front of the housing from the opening of the pocket of the electrical connector. The guide wall is spaced higher than the electrical contact. At least a portion of the guide wall inclines rearward as the guide wall extends downward. The guide wall is unobstructed to contact the corresponding electrical connector of the image forming device during insertion of the replaceable imaging unit into the image forming device for aligning the corresponding electrical connector of the image forming device along a vertical dimension of the housing during insertion of the replaceable imaging unit into the image forming device.

A replaceable imaging unit for use in an electrophotographic image forming device according to another example embodiment includes a housing having a top, a bottom, a front and a rear positioned between a first side and a second side of the housing. The housing includes a photoconductor unit positioned at the front of the housing. The photoconductor unit includes a rotatable photoconductive drum having a rotational axis that extends from the first side of the housing to the second side of the housing. A developer unit is positioned rearward from the photoconductor unit. The developer unit includes a reservoir for storing toner and a rotatable developer roll positioned to transfer toner from the reservoir to the photoconductive drum. An electrical connector is positioned on the photoconductor unit on the first side of the housing. The electrical connector includes an electrical contact positioned within a pocket of the electrical connector that has an opening facing toward the front of the housing to permit a corresponding electrical connector of the image forming device to enter the pocket and contact the electrical contact when the replaceable imaging unit is installed in the image forming device. A longitudinal dimension of the pocket is primarily vertical. A guide wall on the first side of the housing is spaced toward the front of the housing from the opening of the pocket of the electrical connector. The guide wall is spaced higher than the electrical contact. At least a portion of the guide wall inclines rearward as the guide wall extends downward along the longitudinal dimension of the pocket. The guide wall is positioned to contact the corresponding electrical connector of the image forming device during insertion of the replaceable imaging unit into the image forming device for aligning the corresponding electrical connector of the image forming device along the longitudinal dimension of the pocket during insertion of the replaceable imaging unit into the image forming device.

BRIEF DESCRIPTION OF THE DRAWINGS

The accompanying drawings incorporated in and forming a part of the specification, illustrate several aspects of the present disclosure, and together with the description serve to explain the principles of the present disclosure.

DETAILED DESCRIPTION

In the following description, reference is made to the accompanying drawings where like numerals represent like elements. The embodiments are described in sufficient detail to enable those skilled in the art to practice the present disclosure. It is to be understood that other embodiments may be utilized and that process, electrical, and mechanical changes, etc., may be made without departing from the scope of the present disclosure. Examples merely typify possible variations. Portions and features of some embodiments may be included in or substituted for those of others. The following description, therefore, is not to be taken in a limiting sense and the scope of the present disclosure is defined only by the appended claims and their equivalents.

Figure 1:
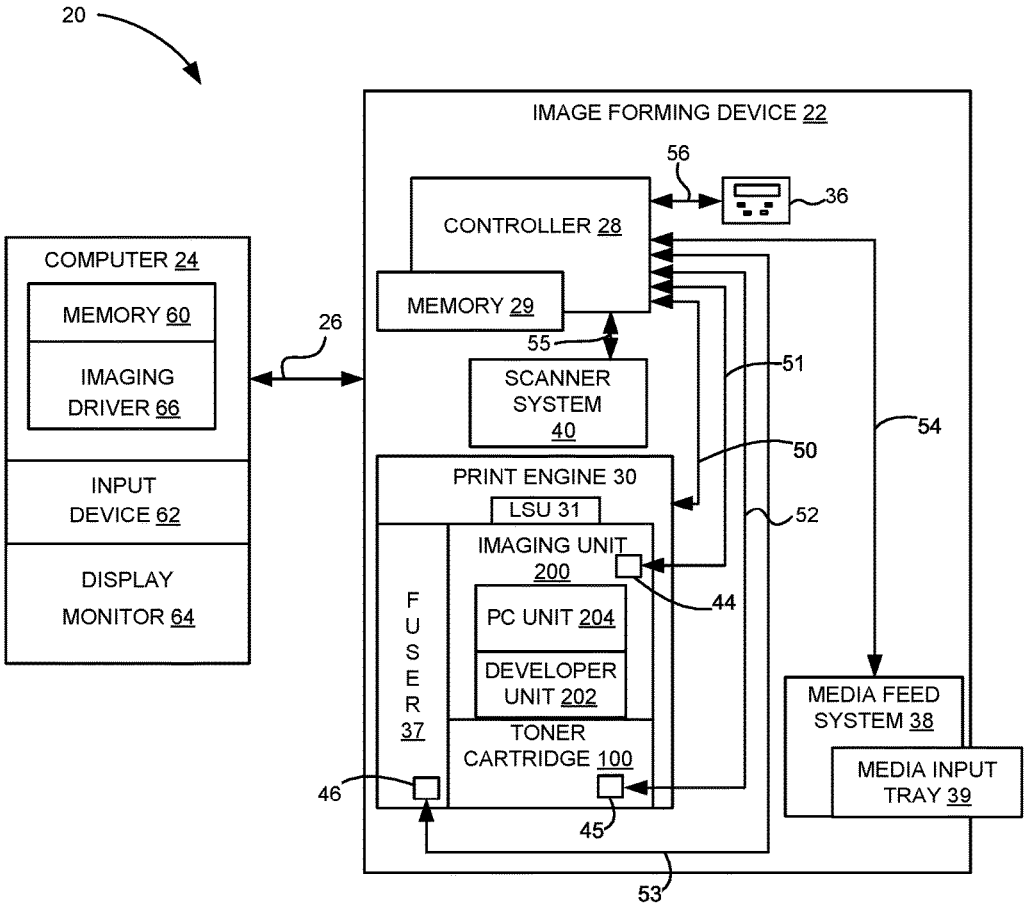
FIG. 1 is a block diagram of an imaging system having an image forming device according to one example embodiment.

Referring now to the drawings and particularly to FIG. 1, there is shown a block diagram depiction of an imaging system 20 according to one example embodiment. Imaging system 20 includes an image forming device 22 and a computer 24. Image forming device 22 communicates with computer 24 via a communications link 26. As used herein, the term "communications link" generally refers to any structure that facilitates electronic communication between multiple components and may operate using wired or wireless technology and may include communications over the Internet.

In the example embodiment shown in FIG. 1, image forming device 22 is a multifunction machine (sometimes referred to as an all-in-one (AIO) device) that includes a controller 28, a print engine 30, a laser scan unit (LSU) 31, an imaging unit 200, a toner cartridge 100, a user interface 36, a media feed system 38, a media input tray 39 and a scanner system 40. Image forming device 22 may communicate with computer 24 via a standard communication protocol, such as, for example, universal serial bus (USB), Ethernet or IEEE 802.xx. Image forming device 22 may be, for example, an electrophotographic printer/copier including an integrated scanner system 40 or a standalone electrophotographic printer.

Controller 28 includes a processor unit and associated electronic memory 29. The processor may include one or more integrated circuits in the form of a microprocessor or central processing unit and may be formed as one or more Application-specific integrated circuits (ASICs). Memory 29 may be any volatile or non-volatile memory or combination thereof, such as, for example, random access memory (RAM), read only memory (ROM), flash memory and/or non-volatile RAM (NVRAM). Memory 29 may be in the form of a separate memory (e.g., RAM, ROM, and/or NVRAM), a hard drive, a CD or DVD drive, or any memory device convenient for use with controller 28. Controller 28 may be, for example, a combined printer and scanner controller.

In the example embodiment illustrated, controller 28 communicates with print engine 30 via a communications link 50. Controller 28 communicates with imaging unit 200 and processing circuitry 44 thereon via a communications link 51. Controller 28 communicates with toner cartridge 100 and processing circuitry 45 thereon via a communications link 52. Controller 28 communicates with a fuser 37 and processing circuitry 46 thereon via a communications link 53. Controller 28 communicates with media feed system 38 via a communications link 54. Controller 28 communicates with scanner system 40 via a communications link 55. User interface 36 is communicatively coupled to controller 28 via a communications link 56. Controller 28 processes print and scan data and operates print engine 30 during printing and scanner system 40 during scanning. Processing circuitry 44, 45, 46 may provide authentication functions, safety and operational interlocks, operating parameters and usage information related to imaging unit 200, toner cartridge 100 and fuser 37, respectively. Each of processing circuitry 44, 45, 46 includes a processor unit and associated electronic memory. As discussed above, the processor may include one or more integrated circuits in the form of a microprocessor or central processing unit and may be formed as one or more Application-specific integrated circuits (ASICs). The memory may be any volatile or non-volatile memory or combination thereof or any memory device convenient for use with processing circuitry 44, 45, 46.

Computer 24, which is optional, may be, for example, a personal computer, including electronic memory 60, such as RAM, ROM, and/or NVRAM, an input device 62, such as a keyboard and/or a mouse, and a display monitor 64.

Computer 24 also includes a processor, input/output (I/O) interfaces, and may include at least one mass data storage device, such as a hard drive, a CD-ROM and/or a DVD unit (not shown). Computer 24 may also be a device capable of communicating with image forming device 22 other than a personal computer such as, for example, a tablet computer, a smartphone, or other electronic device.

In the example embodiment illustrated, computer 24 includes in its memory a software program including program instructions that function as an imaging driver 66, e.g., printer/scanner driver software, for image forming device 22. Imaging driver 66 is in communication with controller 28 of image forming device 22 via communications link 26. Imaging driver 66 facilitates communication between image forming device 22 and computer 24. One aspect of imaging driver 66 may be, for example, to provide formatted print data to image forming device 22, and more particularly to print engine 30, to print an image. Another aspect of imaging driver 66 may be, for example, to facilitate collection of scanned data from scanner system 40.

In some circumstances, it may be desirable to operate image forming device 22 in a standalone mode. In the standalone mode, image forming device 22 is capable of functioning without computer 24. Accordingly, all or a portion of imaging driver 66, or a similar driver, may be located in controller 28 of image forming device 22 so as to accommodate printing and/or scanning functionality when operating in the standalone mode.

Print engine 30 includes a laser scan unit (LSU) 31, toner cartridge 100, imaging unit 200 and fuser 37, all mounted within image forming device 22. Imaging unit 200 is removably mounted in image forming device 22 and includes a developer unit 202 that houses a toner reservoir and a toner development system. In one embodiment, the toner development system utilizes what is commonly referred to as a single component development system. In this embodiment, the toner development system includes a toner adder roll that provides toner from the toner reservoir to a developer roll. A doctor blade provides a metered uniform layer of toner on the surface of the developer roll. In another embodiment, the toner development system utilizes what is commonly referred to as a dual component development system. In this embodiment, toner in the toner reservoir of developer unit 202 is mixed with magnetic carrier beads. The magnetic carrier beads may be coated with a polymeric film to provide triboelectric properties to attract toner to the carrier beads as the toner and the magnetic carrier beads are mixed in the toner reservoir. In this embodiment, developer unit 202 includes a developer roll that attracts the magnetic carrier beads having toner thereon to the developer roll through the use of magnetic fields. Imaging unit 200 also includes a photoconductor unit ("PC unit") 204 that houses a photoconductive drum and a waste toner removal system.

Toner cartridge 100 is removably mounted in imaging forming device 22 in a mating relationship with developer unit 202 of imaging unit 200. An outlet port on toner cartridge 100 communicates with an inlet port on developer unit 202 allowing toner to be periodically transferred from toner cartridge 100 to resupply the toner reservoir in developer unit 202.

The electrophotographic printing process is well known in the art and, therefore, is described briefly herein. During a printing operation, a charge roll in PC unit 204 electrically charges the outer surface of the photoconductive drum in PC unit 204 to a predetermined voltage. Laser scan unit 31 then discharges a selected portion of the outer surface of the photoconductive drum to create a latent image on the outer surface of the photoconductive drum. Toner is transferred from the toner reservoir in developer unit 202 to the latent image on the photoconductive drum by the developer roll to create a toned image on the outer surface of the photoconductive drum. The toned image is then transferred to a media sheet received by imaging unit 200 from media input tray 39 for printing. Toner may be transferred directly to the media sheet by the photoconductive drum or by an intermediate transfer member that receives the toner from the photoconductive drum. Toner remnants are removed from the photoconductive drum by the waste toner removal system. The toner image is bonded to the media sheet in fuser 37 and then sent to an output location or to one or more finishing options such as a duplexer, a stapler or a hole-punch.

Figure 2:
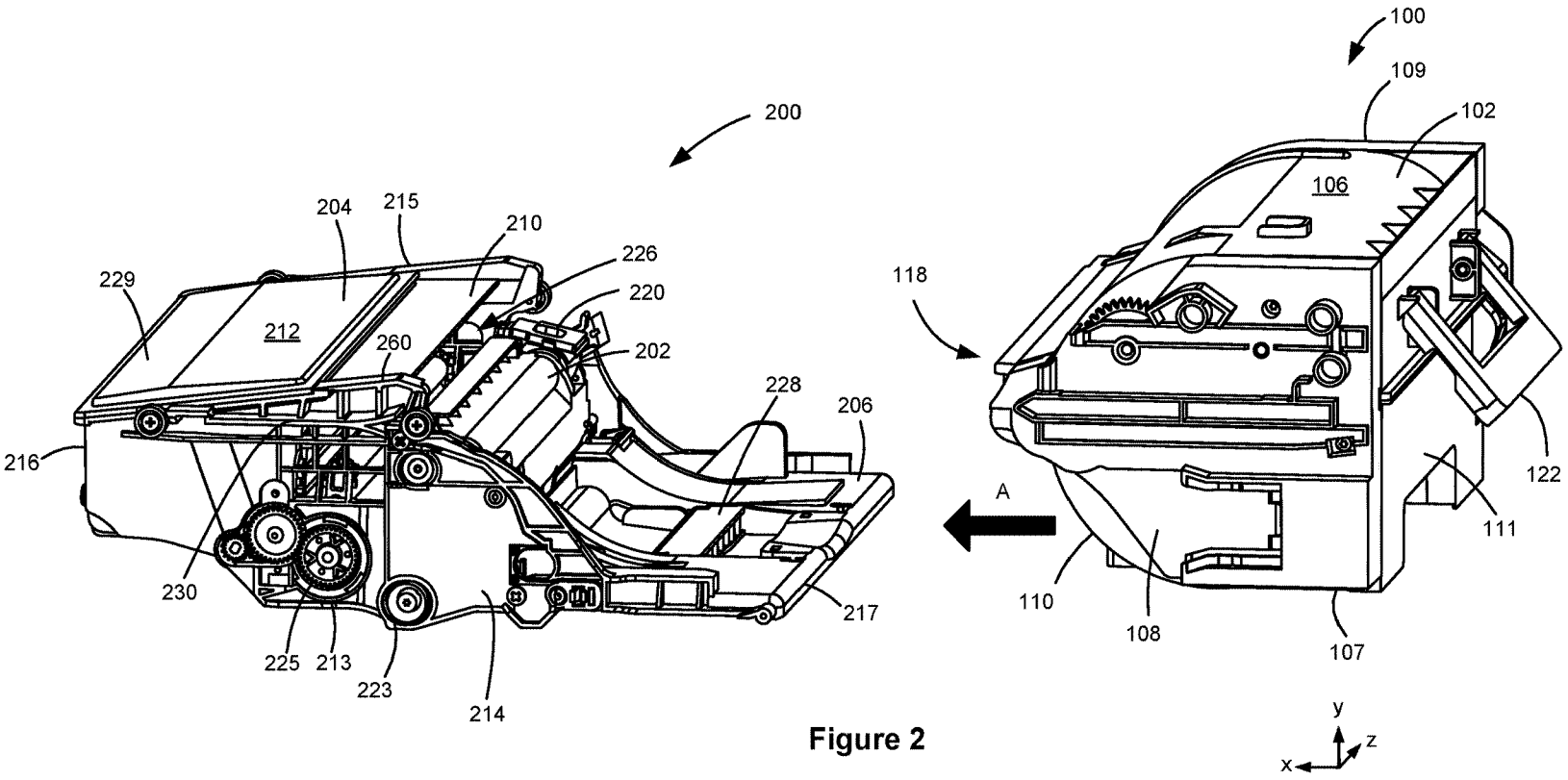
FIG. 2 is a perspective view of a toner cartridge and an imaging unit installable in the image forming device according to one example embodiment.
Figure 3:
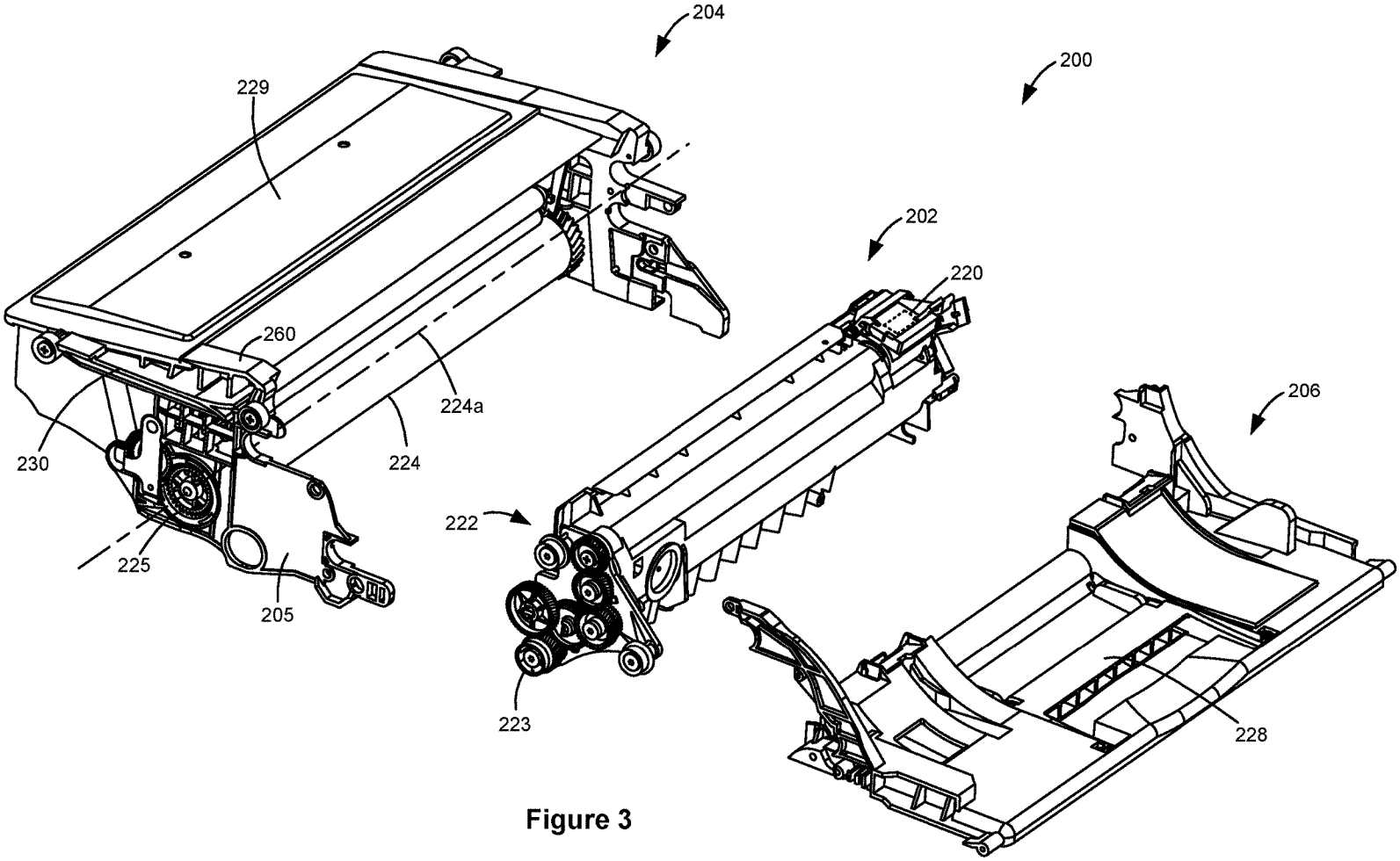
FIG. 3 is an exploded perspective view of the imaging unit shown in FIG. 2.

Referring now to FIG. 2, toner cartridge 100 and imaging unit 200 are shown according to one example embodiment. Toner cartridge 100 includes a housing 102 having an enclosed reservoir for storing toner. Housing 102 includes a top 106, a bottom 107, first and second sides 108, 109, a front 110 and a rear 111. Front 110 of housing 102 leads during insertion of toner cartridge 100 into image forming device 22 and rear 111 trails. An outlet port 118 in fluid communication with the toner reservoir of toner cartridge 100 is positioned facing downward on front 110 of housing 102 near side 109 for exiting toner from toner cartridge 100. A handle 122 may be provided on top 106 or rear 111 of housing 102 to assist with insertion and removal of toner cartridge 100 into and out of image forming device 22.

Imaging unit 200 is shown according to one example embodiment in FIGS. 2-6. In the example embodiment illustrated, imaging unit 200 includes a developer unit 202 mounted against a PC unit 204. A handle frame 206 is attached to PC unit 204. Together, developer unit 202, PC unit 204 and handle frame 206 form a housing 210 of imaging unit 200. Housing 210 includes a top 212, a bottom 213, first and second sides 214, 215, a front 216 and a rear 217. Housing 210 includes a front-to-rear dimension (x-dimension shown in FIG. 2), a vertical dimension (y-dimension shown in FIG. 2) and a side-to-side dimension (z-dimension shown in FIG. 2). Front 216 of housing 210 leads during insertion of imaging unit 200 into image forming device 22 and rear 217 trails. PC unit 204 is positioned at front 216 of housing 210 and handle frame 206 is positioned at rear 217 of housing 210.

Developer unit 202 includes a toner inlet port 220 on top 212 of housing 210 near side 215 that is positioned to receive toner from toner cartridge 100. Toner received by inlet port 220 is stored in the toner reservoir of developer unit 202. Developer unit 202 includes a rotatable developer roll 222 that is mated with a rotatable photoconductive drum ("PC drum") 224 of PC unit 204. As discussed above, developer roll 222 transfers toner from the toner reservoir in developer unit 202 to the latent image on PC drum 224 to create a toned image on the surface of PC drum 224. Developer unit 202 may also include one or more toner agitators for mixing toner stored in the toner reservoir of developer unit 202 and may further include a toner adder roll for moving toner in the toner reservoir to the outer surface of developer roll 222. In the example embodiment illustrated, developer unit 202 includes a drive coupler 223 exposed on side 214 of housing 210. Drive coupler 223 mates with a corresponding drive coupler in image forming device 22 when imaging unit 200 is installed in image forming device 22 in order to receive rotational motion from an electric motor in image forming device 22. Drive coupler 223 is rotatably coupled to developer roll 222 via a drive train on developer unit 202 such that rotation of drive coupler 223 provides rotational motion to developer roll 222. Drive coupler 223 may also be rotatably coupled to other components of developer unit 202, such as a toner adder roll and/or various toner agitators of developer unit 202.

PC unit 204 includes a drive coupler 225 exposed on side 214 of housing 210. Drive coupler 225 mates with a corresponding drive coupler in image forming device 22 when imaging unit 200 is installed in image forming device 22 in order to receive rotational motion from an electric motor in image forming device 22. Drive coupler 225 is rotatably coupled to PC drum 224 such that rotation of drive coupler 225 provides rotational motion to PC drum 224. For example, in the embodiment illustrated, drive coupler 225 is positioned on an axial end of PC drum 224. A portion of the outer surface of PC drum 224 is exposed on bottom 213 of housing 210. A rotational axis 224*a* of PC drum 224 is parallel to the side-to-side dimension of housing 210. Toner on the outer surface of PC drum 224 is transferred from the portion of the outer surface of PC drum 224 that is exposed on bottom 213 of housing 210 to a media sheet or intermediate transfer member during a print operation. A narrow slit 226 is formed between PC unit 204 and developer unit 202 at the top 212 of housing 210. Slit 226 permits a laser of laser scan unit 31 to discharge selected portions of the outer surface of PC drum 224 in order to create the latent image on the outer surface of PC drum 224. PC unit 204 also includes a rotatable charge roll in contact with the outer surface of PC drum 224 that charges the outer surface of PC drum 224 to a predetermined voltage. PC unit 204 also includes a waste toner removal system that may include a cleaner blade or roll that removes residual toner from the outer surface of PC drum 224. In the example embodiment illustrated, PC unit 204 includes a waste toner sump 229 positioned at the front 216 of housing 210. Waste toner sump 229 stores toner removed from PC drum 224 by the cleaner blade or roll.

Handle frame 206 includes a handle 228 exposed on housing 210 for user engagement to assist with insertion and removal of imaging unit 200 into and out of image forming device 22. Handle frame 206 may also include alignment features that aid in aligning toner cartridge 100 with imaging unit 200 during insertion of toner cartridge 100 into image forming device 22.

With reference back to FIG. 2, as discussed above, toner cartridge 100 and imaging unit 200 are each removably installable in image forming device 22. Imaging unit 200 is first slidably inserted into image forming device 22. Toner cartridge 100 is then inserted into image forming device 22 and onto handle frame 206 in a mating relationship with developer unit 202 of imaging unit 200 as indicated by the arrow A shown in FIG. 2, which also indicates the direction of insertion of toner cartridge 100 and imaging unit 200 into image forming device 22. This arrangement allows toner cartridge 100 to be removed and reinserted easily when replacing an empty toner cartridge 100 without having to remove imaging unit 200. Imaging unit 200 may also be readily removed as desired in order to maintain, repair or replace the components associated with developer unit 202, photoconductor unit 204 or handle frame 206 or to clear a media jam. With reference back to FIGS. 2-6, sides 214, 215 may each include an alignment guide 230 that extends outward from the respective side 214, 215 to assist the insertion of imaging unit 200 into image forming device 22. Alignment guides 230 travel in corresponding guide slots in image forming device 22 that guide the insertion of imaging unit 200 into image forming device 22. In the example embodiment illustrated, alignment guides 230 are positioned on a frame 205 of PC unit 204. Alignment guides 230 may run along the front-to-rear dimension of housing 102 as shown in FIGS. 2-6.

Figure 4:
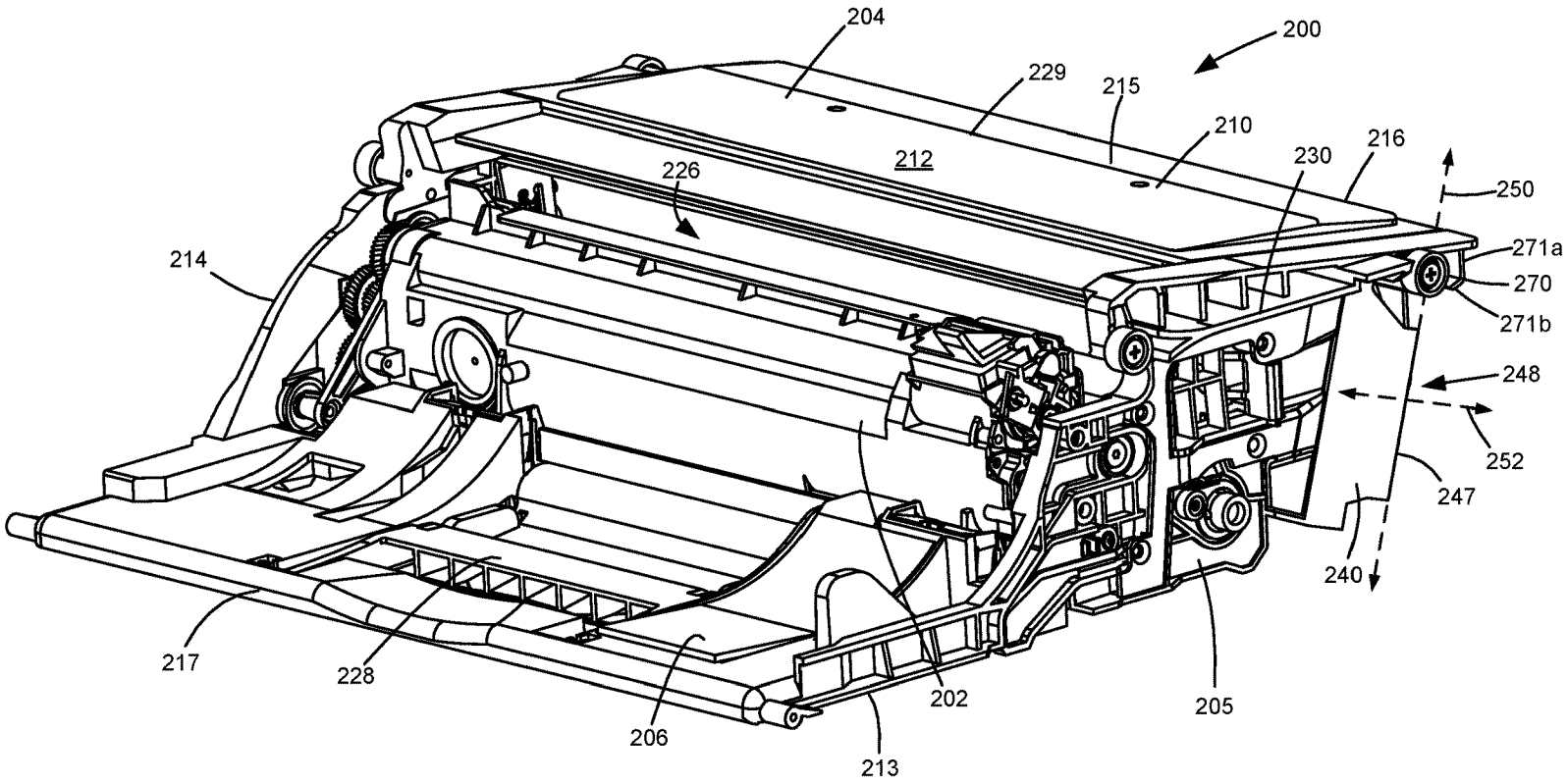
FIG. 4 is a first perspective view of the imaging unit shown in FIGS. 2 and 3.
Figure 5:
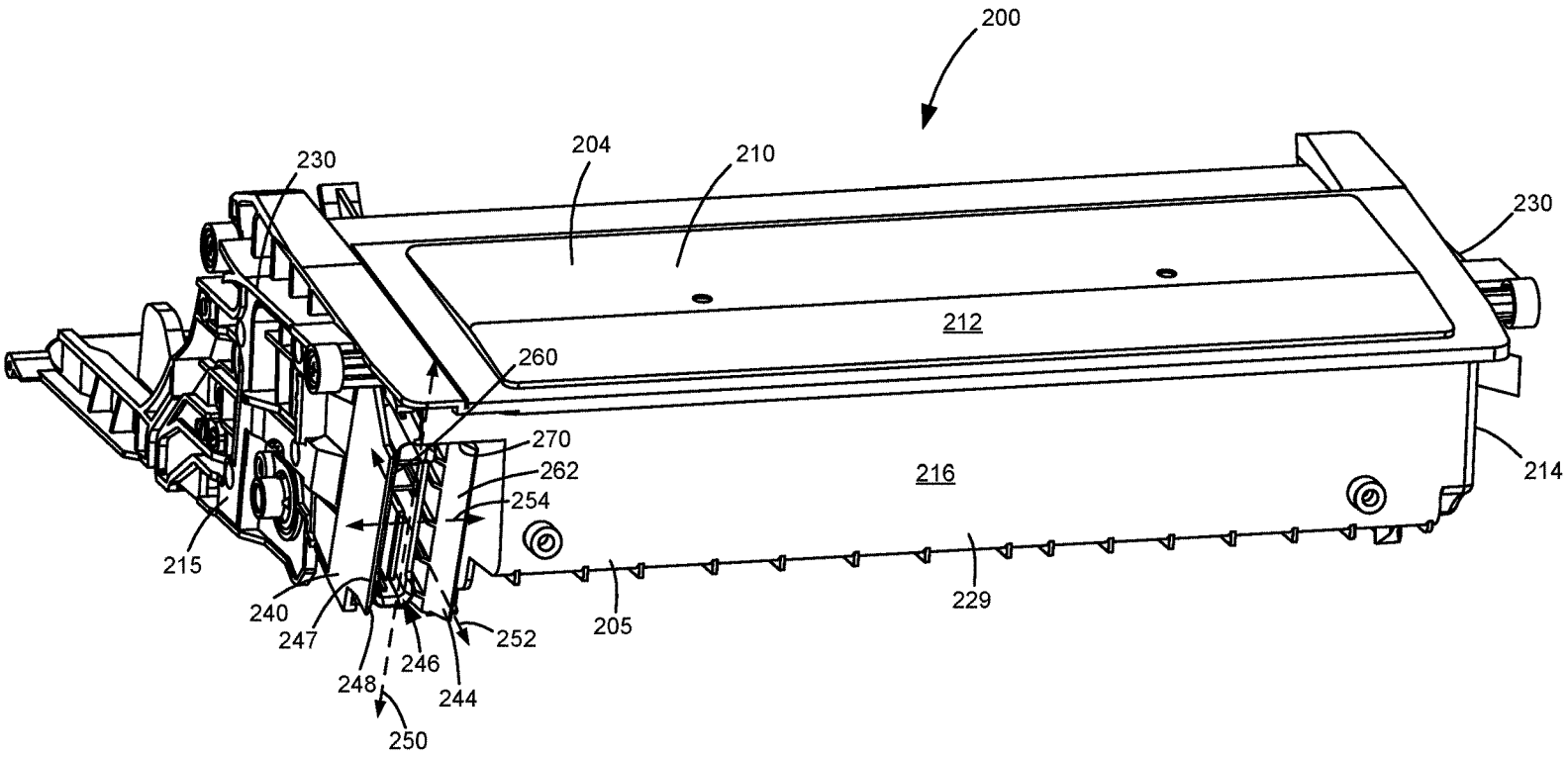
FIG. 5 is a second perspective view of the imaging unit shown in FIGS. 2-4.
Figure 6:
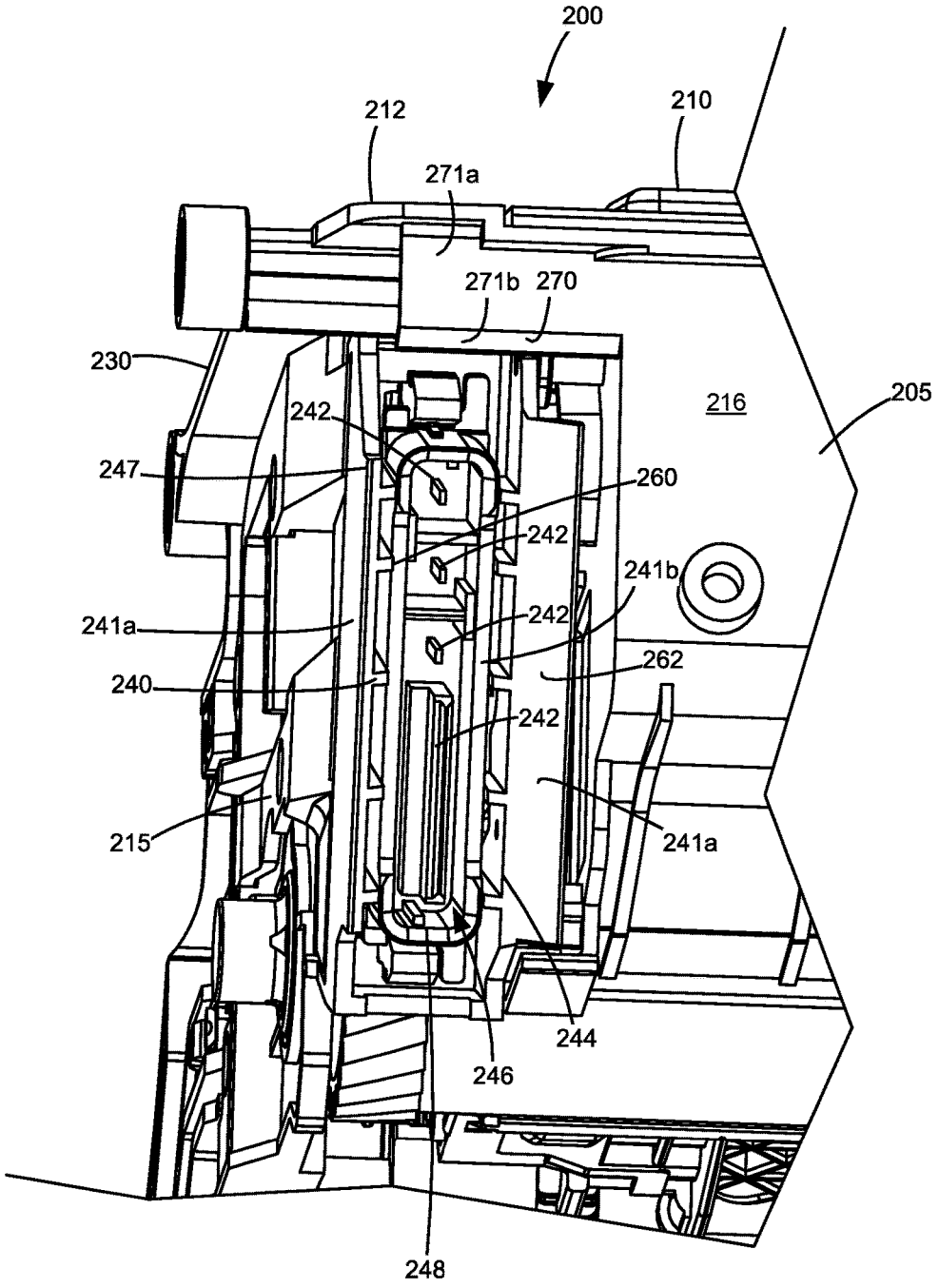
FIG. 6 is a third perspective view of the imaging unit shown in FIGS. 2-5.

With reference to FIGS. 4-6, imaging unit 200 includes an electrical connector assembly 240 positioned on side 215 of housing 210, near front 216. Electrical connector 240 is mounted on frame 205 of PC unit 204 on side 215 next to waste toner sump 229. Electrical connector 240 includes a connector housing 241*a* and a connector interface 241*b*. Connector interface 241*b* of electrical connector 240 includes one or more electrical contacts 242. In some embodiments, electrical connector 240 includes a standard connector interface, such as, for example, a JST electrical connector manufactured by J.S.T. Mfg. Co., Ltd., Osaka, Japan. However, a custom connector interface may be used instead as desired. Electrical connector 240 may include a male plug end of the connector interface or a female socket, port or jack end of the connector interface with a corresponding electrical connector in image forming device 22 forming the opposite female or male end of the connector interface. For example, in the example embodiment illustrated, electrical connector 240 includes a female socket 244. In this embodiment, electrical contacts 242 are positioned within a pocket 246 of electrical connector 240 that is sized to receive the corresponding male plug end of the corresponding electrical connector in image forming device 22. Pocket 246 includes a forward facing opening 248 at a front end 247 of pocket 246 that faces toward front 216 of housing 210. Opening 248 permits the male plug end of the corresponding electrical connector in image forming device 22 to enter pocket 246 as imaging unit 200 is inserted into image forming device 22 as discussed in greater detail below. In the example embodiment illustrated, pocket 246 and opening 248 are tilted forward relative to the vertical dimension of housing 210, such as, for example, by about 17.5 degrees, such that a longitudinal dimension 250 of pocket 246 of electrical connector 240 is primarily vertical but is angled forward relative to the vertical dimension of housing 210. Similarly, an insertion dimension 252 into pocket 246 of electrical connector 240, along which the corresponding electrical connector in image forming device 22 enters (and exits) pocket 246, is primarily horizontal but is angled downward relative to the front-to-rear dimension of housing 210 in the example embodiment illustrated. However, in the example embodiment illustrated, a lateral dimension 254 of pocket 246 of electrical connector 240 is parallel to the side-to-side dimension of housing 210 and the axial dimension of PC drum 224.

One or more electrical contacts 242 may be electrically connected to processing circuitry 44 mounted on housing 210. For example, processing circuitry 44 may be mounted on an inner side surface of electrical connector 240, next to waste toner sump 229. In addition or in the alternative, one or more electrical contacts 242 of electrical connector 240 may supply an electrical load to one or more components of developer unit 202 and/or PC unit 204. For example, in one embodiment, electrical connector 240 includes respective electrical contacts 242 that supply an electrical load to one of developer roll 222, a toner adder roll of developer unit 202 and a doctor blade of developer unit 202. In one embodiment, electrical connector 240 includes electrical contacts 242 for a toner level sensing system of the type described in U.S. Pat. No. 8,718,496 for determining an amount of toner present in the toner reservoir of developer unit 202. Electrical contacts 242 may also include one or more ground contacts as needed for use with processing circuitry 44 and/or components of developer unit 202 and/or PC unit 204.

A pair of inclined guide walls 260, 262 are positioned on opposite sides of opening 248 to pocket 246, at front end 247 of pocket 246. Guide walls 260, 262 aid in aligning the corresponding electrical connector in image forming device 22 along lateral dimension 254 of electrical connector 240 (i.e., along the side-to-side dimension of housing 210) during insertion of imaging unit 200 into image forming device 22 as discussed in greater detail below. Guide wall 260 is positioned at an outer side of opening 248 and guide wall 262 is positioned at an inner side of opening 248 such that guide wall 260 is spaced outward sideways from guide wall 262 with opening 248 positioned between guide walls 260, 262. Guide wall 260 inclines inward sideways along lateral dimension 254 of electrical connector 240 as guide wall 260 extends rearward along insertion dimension 252 of electrical connector 240 and guide wall 262 inclines outward sideways along lateral dimension 254 of electrical connector 240 as guide wall 262 extends rearward along insertion dimension 252 of electrical connector 240.

An inclined guide wall 270 is positioned on side 215 of housing 210 and is spaced forward from guide walls 260, 262 and from opening 248 to pocket 246. Guide wall 270 aids in aligning the corresponding electrical connector in image forming device 22 along the vertical dimension of housing 210 and, more particularly, along longitudinal dimension 250 of electrical connector 240 during insertion of imaging unit 200 into image forming device 22 as discussed in greater detail below. In the example embodiment illustrated, guide wall 270 is positioned at a front end of housing 210, at a front end of waste toner sump 229. In the embodiment illustrated, guide wall 270 is formed integrally with frame 205 of PC unit 204. In this embodiment, guide wall 270 includes a flange that extends downward from top 212 of housing 210 and outward sideways from a portion of frame 205 forming waste toner sump 229. Guide wall 270 is spaced higher than electrical contacts 242 and opening 248 to pocket 246. At least a portion of guide wall 270 inclines rearward along insertion dimension 252 of electrical connector 240 as guide wall 270 extends downward along longitudinal dimension 250 of electrical connector 240. In the example embodiment illustrated, guide wall 270 includes a first segment 271*a* and a second segment 271*b*. In this embodiment, first segment 271*a* is vertically oriented relative to the vertical dimension of housing 210 and second segment 271*b* is angled rearward along the front-to-rear dimension of housing 210 as second segment 271*b* extends downward along the vertical dimension of housing 210 (and is angled rearward along insertion dimension 252 of electrical connector 240 as second segment 271*b* extends downward along longitudinal dimension 250 of electrical connector 240).

Figure 7:
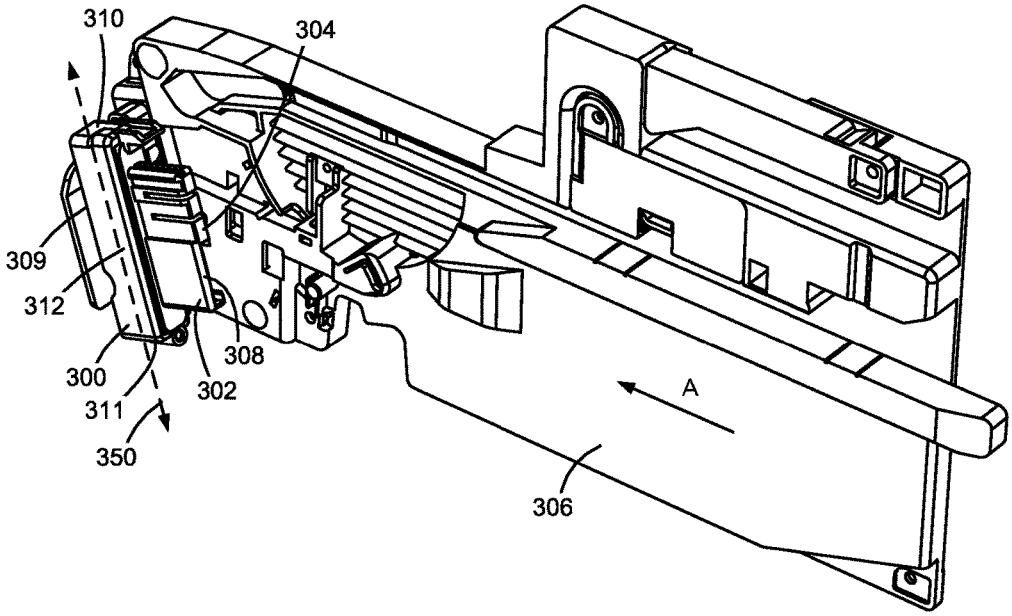
FIG. 7 is a perspective view of a first side of an electrical connector positioned on a frame of the image forming device according to one example embodiment.
Figure 8:
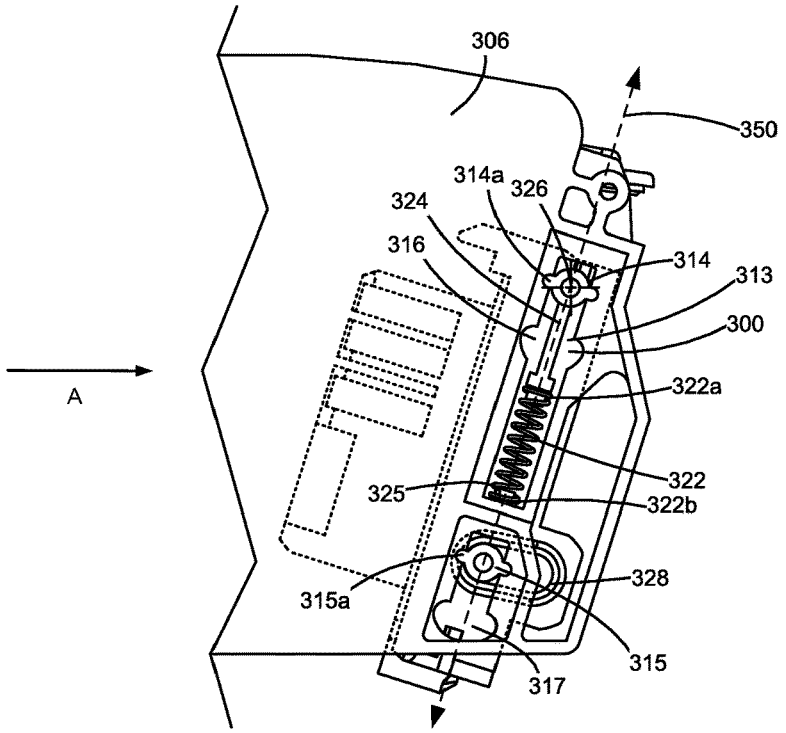
FIG. 8 is a side elevation view of a second side of the electrical connector shown in FIG. 7 positioned on the frame of the image forming device.
Figure 9:
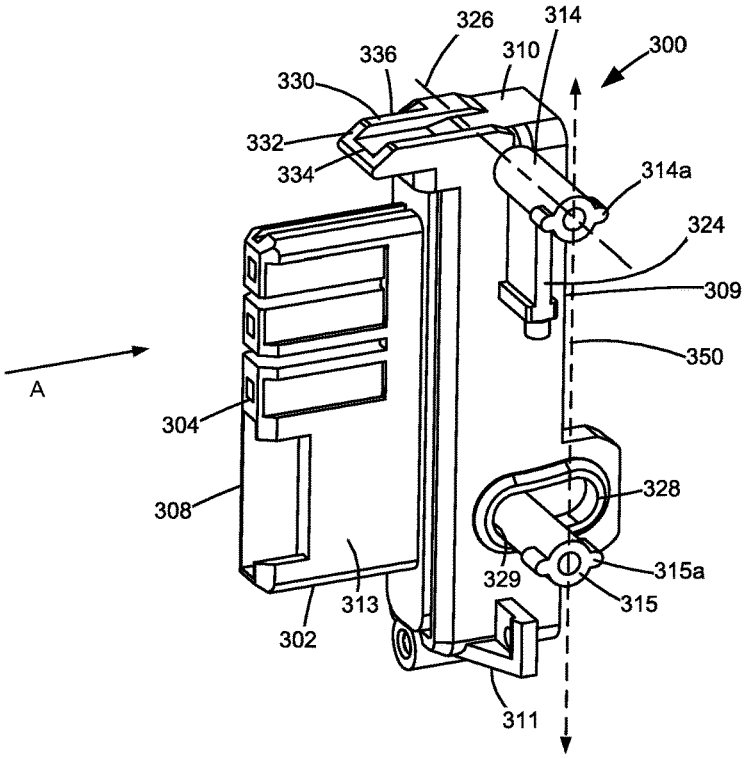
FIG. 9 is a perspective view of the second side of the electrical connector shown in FIGS. 7 and 8 with the frame of the image forming device omitted.

FIGS. 7-9 show an electrical connector 300 in image forming device 22 according to one example embodiment that is configured to operate with electrical connector 240 shown in FIGS. 4-6. In the example embodiment illustrated, electrical connector 300 includes a male plug 302 of a JST electrical connector. However, as discussed above, electrical connector 300 may include a male or female connector depending on the configuration of electrical connector 240 and may include a standard or custom connector interface. Electrical connector 300 includes one or more electrical contacts 304 positioned on male plug 302 that contact corresponding electrical contacts 242 of electrical connector 240 when imaging unit 200 is installed in image forming device 22. Electrical contacts 304 are electrically connected to controller 28 in order to permit communication between processing circuitry 44 and controller 28 and to permit control of the electrical load to one or more components of developer unit 202 and/or PC unit 204 when electrical contacts 242 mate with electrical contacts 304.

Electrical connector 300 is mounted to a frame 306 of image forming device 22 at a position to engage electrical connector 240 when imaging unit 200 is installed in image forming device 22. The portions of electrical connector 300 obscured by frame 306 in FIG. 8 are shown in broken line. Frame 306 is omitted from FIG. 9 to more clearly illustrate the features of electrical connector 300. Frame 306 extends along the direction of insertion of imaging unit 200 into image forming device 22. In the example embodiment illustrated, electrical connector 300 is positioned adjacent to side 215 when imaging unit 200 is installed in image forming device 22. Electrical connector 300 includes a leading end 308 and a trailing end 309. The arrow A in FIGS. 7-9 indicates the direction of insertion of toner cartridge 100 and imaging unit 200 into image forming device 22. Leading end 308 is positioned closer to the direction from which imaging unit 200 enters image forming device 22 and trailing end 309 is positioned farther from the direction from which imaging unit 200 enters image forming device 22 such that imaging unit 200 reaches leading end 308 before reaching trailing end 309 as imaging unit 200 is inserted into image forming device 22. Male plug 302 and electrical contacts 304 are positioned on leading end 308 of electrical connector 300. Electrical connector 300 also includes a top 310, a bottom 311, an outer side 312 that faces toward imaging unit 200 and an inner side 313 that faces away from imaging unit 200 and toward frame 306.

Electrical connector 300 is tilted with respect to the insertion direction of imaging unit 200 into image forming device 22 in a manner that generally corresponds to the angle of pocket 246 and opening 248 of electrical connector 240 such that male plug 302 and electrical contacts 304 extend generally along insertion dimension 252 of electrical connector 240 in order to permit male plug 302 of electrical connector 300 to enter pocket 246 of electrical connector 240 when imaging unit 200 is installed in image forming device 22. Electrical connector 300 is translatable toward and away from frame 306, sideways with respect to imaging unit 200 along the side-to-side dimension of housing, the axial dimension of PC drum 224 and lateral dimension 254 of electrical connector 240. Electrical connector 300 is also translatable along a longitudinal dimension 350 of electrical connector 300 that is perpendicular to the translation of electrical connector 300 toward and away from frame 306 and to the axial dimension of PC drum 224 and lateral dimension 254 of electrical connector 240. In the example embodiment illustrated, electrical connector 300 includes a pair of guide posts 314, 315 that extend from inner side 313 of electrical connector 300 toward frame 306. In the example embodiment illustrated, post 314 is fixedly positioned on electrical connector 300 and post 315 is movable relative to electrical connector 300 along a pivot path as discussed in greater detail below. Longitudinal dimension 350 of electrical connector 300 is defined by an imaginary line from post 314 to post 315. In the example embodiment illustrated, each post 314, 315 is received in a respective elongated slot 316, 317 in frame 306; however, posts 314, 315 may alternatively be received by a common elongated slot in frame 306. The engagement between posts 314, 315 and slots 316, 317 guides the movement of electrical connector 300 along longitudinal dimension 350. In the example embodiment illustrated, each post 314, 315 also includes one or more stops 314*a*, 315*a* that limit the movement of electrical connector 300 away from frame 306. Inner side 313 of electrical connector 300 may limit the movement of electrical connector 300 toward frame 306.

In the example embodiment illustrated, electrical connector 300 is biased upward along longitudinal dimension 350 of electrical connector 300 by a biasing member, such as, for example, a compression spring 322. In the example embodiment illustrated, a first end 322*a* of spring 322 is positioned against a rib 324 formed on inner side 313 of electrical connector 300 and a second end 322*b* of spring 322 is positioned against an anchor 325 on frame 306. Although the example embodiment illustrated includes a compression spring 322, it will be appreciated that any suitable biasing member may be used as desired including, for example, an extension spring or a material having resilient properties.

Electrical connector 300 is also pivotable about a pivot axis 326 that is parallel to lateral dimension 254 of electrical connector 240 (and to the side-to-side dimension of housing 210 and the axial dimension of PC drum 224). In the example embodiment illustrated, guide post 314 defines the pivot axis 326 of electrical connector 300 and guide post 315 is received in an elongated slot 328 on electrical connector 300 that defines the range of motion of electrical connector 300 along a pivot path of electrical connector 300 about pivot axis 326. In the example embodiment illustrated, elongated slot 328 includes a datum surface 329 that defines an operating position of electrical connector 300 along the pivot path about pivot axis 326. Specifically, electrical connector 300 is at the operating position along the pivot path when guide post 315 is in contact with datum surface 329 of elongated slot 328.

Electrical connector 300 includes a guide surface 330 on top 310 of electrical connector 300 that aids in aligning electrical connector 300 with electrical connector 240 of imaging unit 200 during insertion of imaging unit 200 into image forming device 22 as discussed in greater detail below. Guide surface 330 includes a tapered lead-in 332 at a leading edge 334 of guide surface 330 and a trailing portion 336 that extends from tapered lead-in 332 away from leading edge 334.

Figure 10:
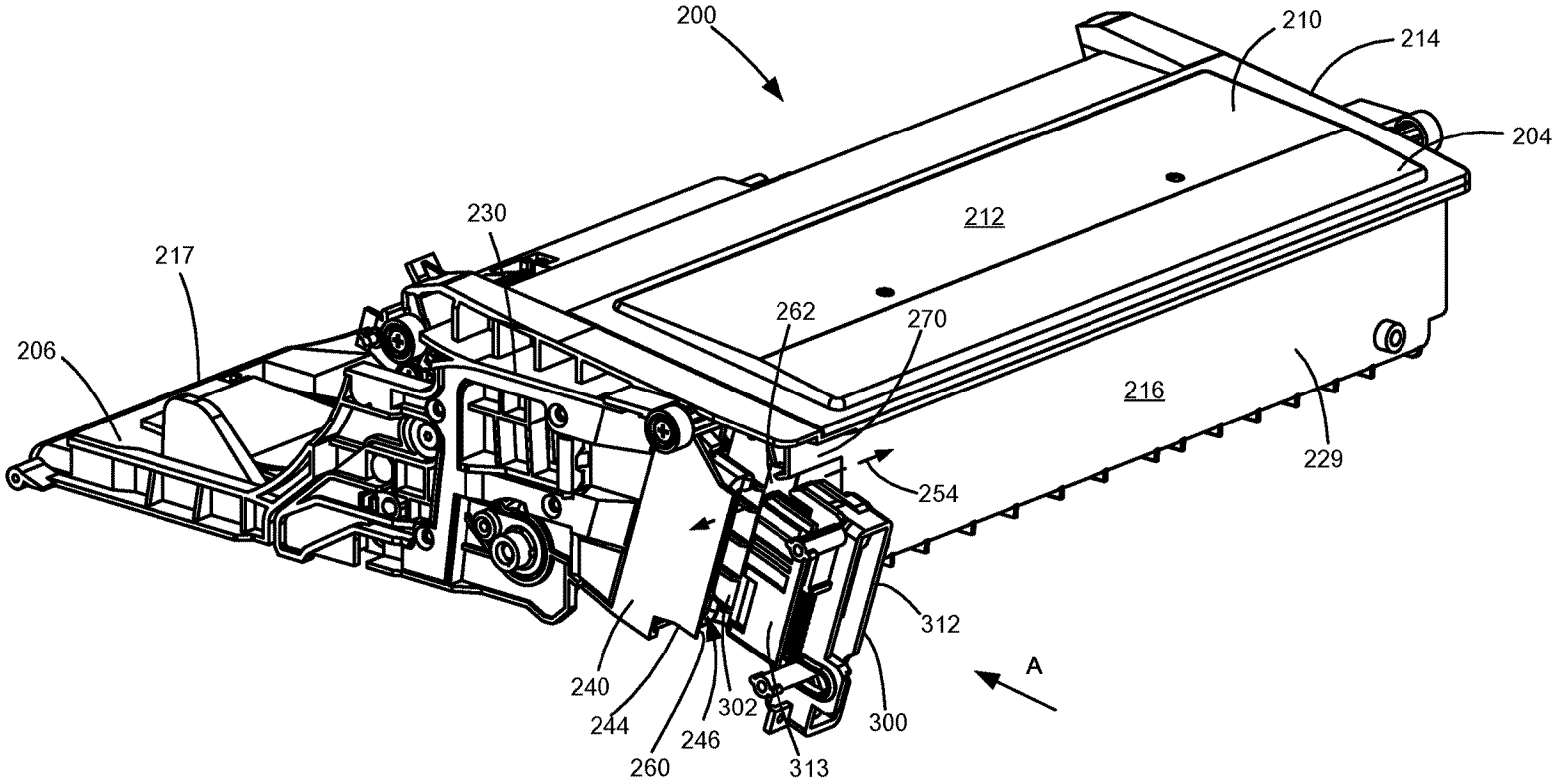
FIG. 10 is a perspective view showing the electrical connector in the image forming device beginning to engage an electrical connector on the imaging unit during insertion of the imaging unit into the image forming device according to one example embodiment.

FIG. 10 shows imaging unit 200 during insertion into image forming device 22 (along the direction indicated by arrow A) as electrical connector 240 approaches corresponding electrical connector 300 in image forming device 22. If male plug 302 of electrical connector 300 is misaligned with pocket 246 of electrical connector 240 in the lateral dimension 254 of electrical connector 240 as guide walls 260, 262 first reach male plug 302, the inclined surface of guide wall 260 will contact inner side 313 of male plug 302 or guide wall 262 will contact outer side 312 of male plug 302. The contact between guide wall 260 or 262 and inner side 313 or outer side 312 of male plug 302 causes electrical connector 300 to move toward or away from, respectively, imaging unit 200 along lateral dimension 254 of electrical connector 240 as imaging unit 200 continues to advance into image forming device 22 as a result of the angles of guides 260, 262 until male plug 302 of electrical connector 300 is aligned in the lateral dimension 254 of electrical connector 240 with pocket 246 of electrical connector 240. As imaging unit 200 continues to advance, once male plug 302 enters socket 244 of electrical connector 240, the engagement between male plug 302 and socket 244 controls the alignment of electrical connector 300 with electrical connector 240 along the lateral dimension 254 of electrical connector 240.

Figure 11:
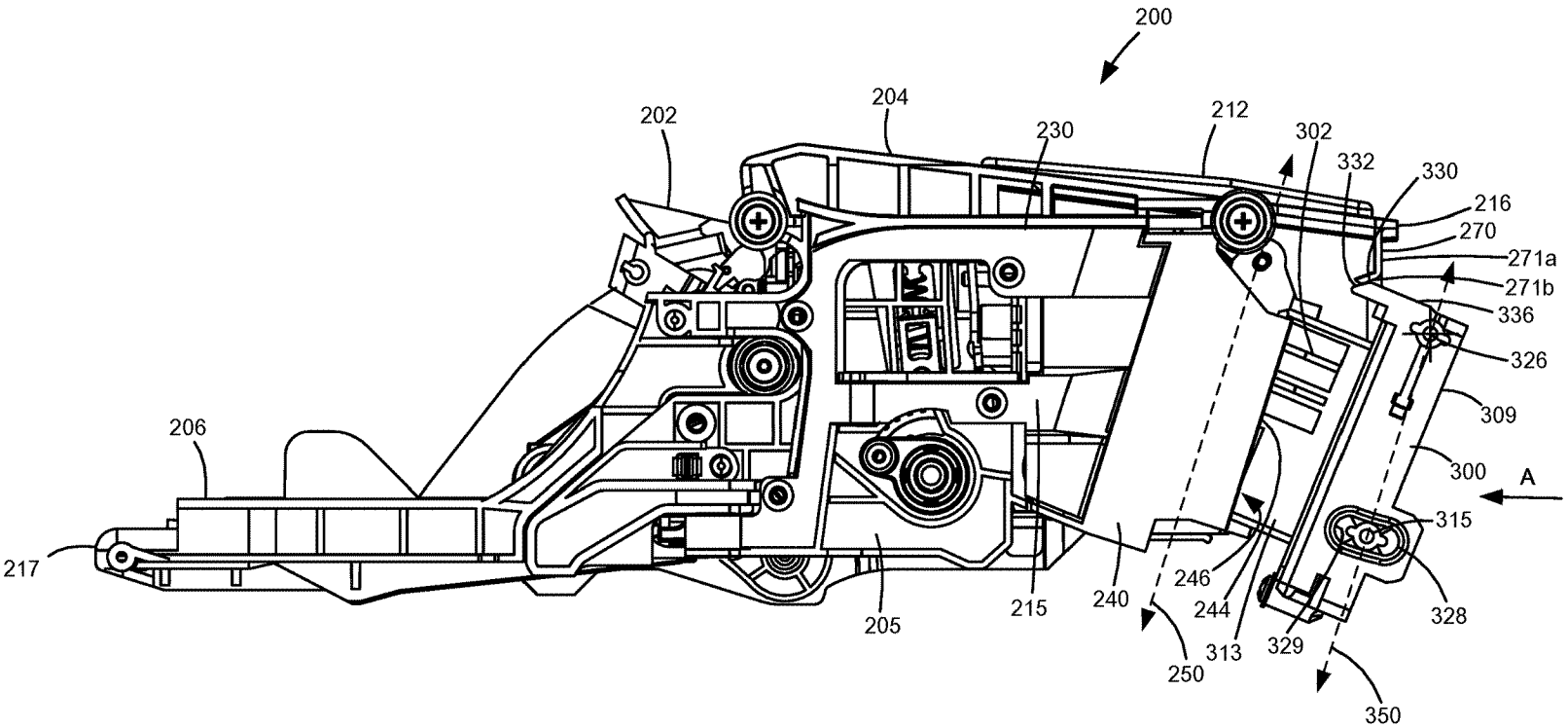
FIGS. 11-13 are sequential side elevation views showing the position of the electrical connector in the image forming device relative to the electrical connector on the imaging unit during insertion of the imaging unit into the image forming device according to one example embodiment.
Figure 12:
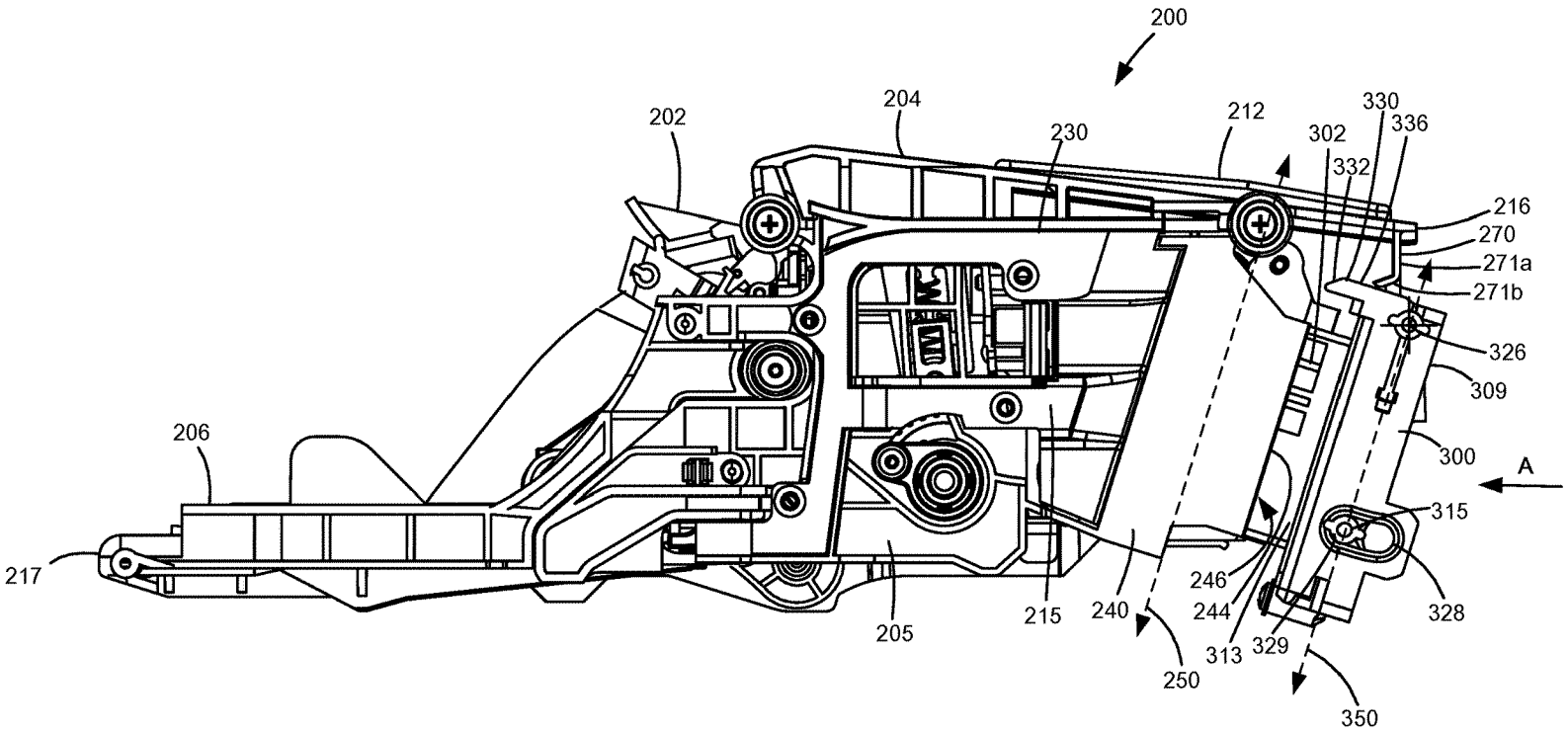
Figure 13:
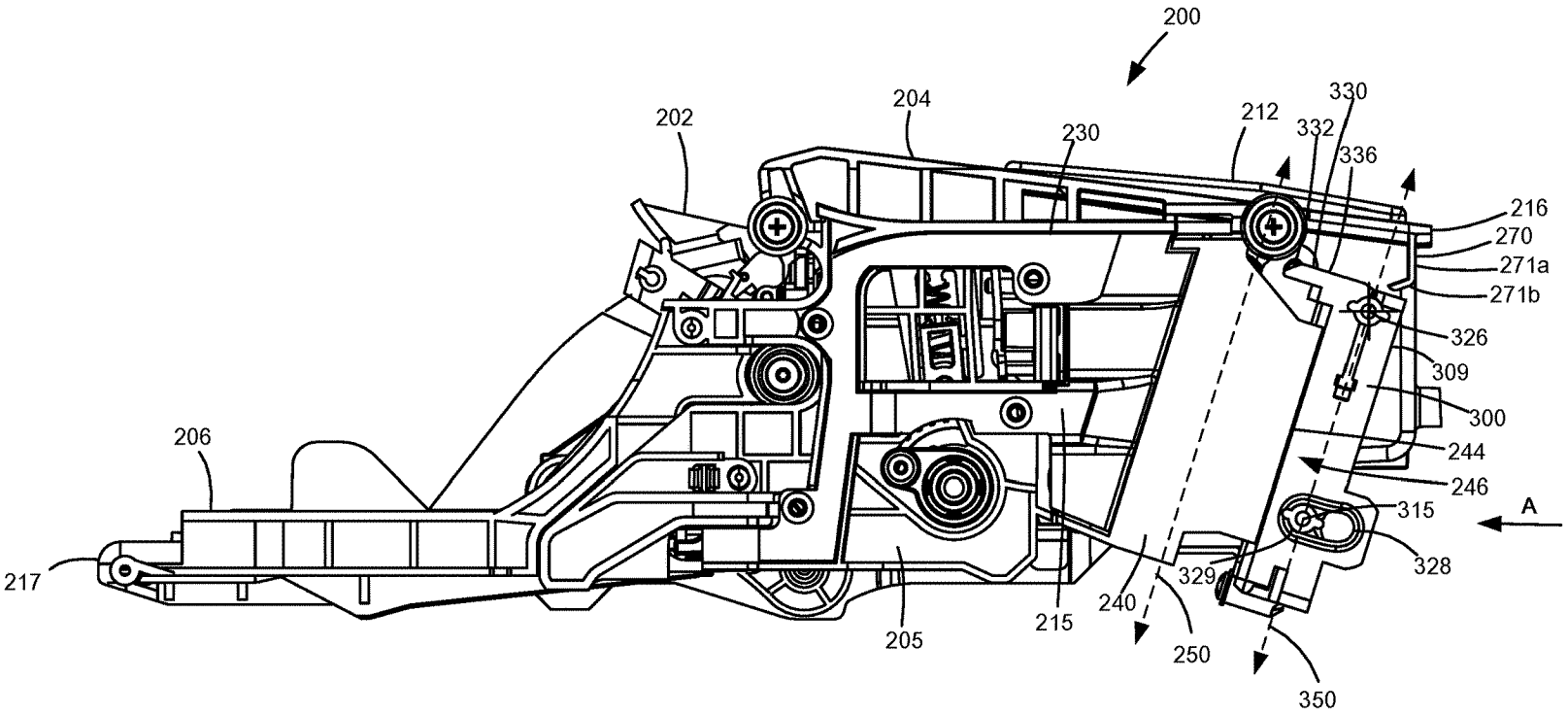

FIGS. 11-13 are sequential views further illustrating the positioning of electrical connector 240 and electrical connector 300 as imaging unit 200 is inserted into image forming device 22 along the direction indicated by arrow A. FIG. 11 shows the position of electrical connector 300 relative to electrical connector 240 as imaging unit 200 advances and male plug 302 of electrical connector 300 approaches pocket 246 of electrical connector 240. If male plug 302 of electrical connector 300 is misaligned with pocket 246 of electrical connector 240 in the longitudinal dimension 250 of electrical connector 240 or tilted along the pivot path about pivot axis 326 relative to electrical connector 240 as guide wall 270 first reaches guide surface 330, angled second segment 271*b* of guide wall 270 contacts tapered lead-in 332 of guide surface 330. Contact between angled second segment 271*b* of guide wall 270 and tapered lead-in 332 of guide surface 330 causes electrical connector 300 to move downward, against the bias on electrical connector 300, along longitudinal dimension 350 of electrical connector 300 and to pivot counterclockwise (as viewed in FIGS. 11-13) about pivot axis 326 as imaging unit 200 continues to advance into image forming device 22 as a result of the angles of second segment 271*b* of guide 270 and tapered lead-in 332 of guide surface 330. Electrical connector 300 continues to move downward along longitudinal dimension 350 of electrical connector 300 and to pivot counterclockwise about pivot axis 326 as viewed until male plug 302 of electrical connector 300 is aligned in the longitudinal dimension 250 of electrical connector 240 with pocket 246 of electrical connector 240 and guide post 315 is in contact with datum surface 329 of elongated slot 328.

FIG. 12 shows imaging unit 200 advanced further into image forming device 22 with male plug 302 of electrical connector 300 advanced into pocket 246 of electrical connector 240. FIG. 12 shows electrical connector 300 aligned with pocket 246 of electrical connector 240 in the longitudinal dimension 250 of electrical connector 240 and about pivot axis 326. As imaging unit 200 advances, angled second segment 271*b* of guide wall 270 passes tapered lead-in 332 of guide surface 330 and contacts trailing portion 336 of guide surface 330. Contact between angled second segment 271*b* of guide wall 270 and trailing portion 336 of guide surface 330 maintains the position of electrical connector 300 relative to electrical connector 240 along the longitudinal dimension 250 of electrical connector 240 and about pivot axis 326 as male plug 302 advances into pocket 246.

FIG. 13 shows imaging unit 200 installed in its final operating position in image forming device 22 with male plug 302 of electrical connector 300 fully inserted into pocket 246 of electrical connector 240. In the example embodiment illustrated, as imaging unit 200 reaches its final position in image forming device 22, angled second segment 271*b* of guide wall 270 disengages from guide surface 330 such that guide wall 270 is not in contact with electrical connector 300 when imaging unit 200 is in its final position in image forming device 22 so as not to over-constrain electrical connector 300. Instead, the engagement between male plug 302 and socket 244 controls the final position of electrical connector 300 along the longitudinal dimension 250 of electrical connector 240 and about pivot axis 326.

In the example embodiment illustrated, the freedom of movement of electrical connector 300 along longitudinal dimension 350 of electrical connector 300 and lateral dimension 254 of electrical connector 240 and about pivot axis 326 reduces the force applied to electrical connector 240 of imaging unit 200 by electrical connector 300 when imaging unit 200 is installed in its final operating position in image forming device 22. In some embodiments, when imaging unit 200 is in its final operating position in image forming device 22, only the relatively small force from the biasing member of electrical connector 300 is applied to electrical connector 240 of imaging unit 200. Guide walls 260, 262 and 270 of imaging unit 200 help ensure that electrical connector 240 successfully mates with corresponding electrical connector 300 in image forming device 22 upon insertion of imaging unit 200 into image forming device 22 regardless of the position of electrical connector 300. Further, the freedom of electrical connector 300 to pivot about pivot axis 326 permits a user to remove imaging unit 200 from image forming device 22 by grasping handle 228 and lifting upward as the user pulls imaging unit 200 from image forming device without binding electrical connector 300.

Although the example image forming device 22 discussed above includes one toner cartridge 100 and corresponding imaging unit 200, in the case of an image forming device configured to print in color, separate replaceable units may be used for each toner color needed. For example, in one embodiment, the image forming device includes four toner cartridges and four corresponding imaging units, each toner cartridge containing a particular toner color (e.g., black, cyan, yellow and magenta) and each imaging unit corresponding with one of the toner cartridges to permit color printing.

The foregoing description illustrates various aspects of the present disclosure. It is not intended to be exhaustive. Rather, it is chosen to illustrate the principles of the present disclosure and its practical application to enable one of ordinary skill in the art to utilize the present disclosure, including its various modifications that naturally follow. All modifications and variations are contemplated within the scope of the present disclosure as determined by the appended claims. Relatively apparent modifications include combining one or more features of various embodiments with features of other embodiments.

The invention claimed is:

1. A replaceable imaging unit for use in an electrophotographic image forming device, comprising:

a housing having a top, a bottom, a front and a rear positioned between a first side and a second side of the housing, the housing includes:

a photoconductor unit positioned at the front of the housing, the photoconductor unit includes a rotatable photoconductive drum having a rotational axis that extends from the first side of the housing to the second side of the housing; and a developer unit positioned rearward from the photoconductor unit, the developer unit includes a reservoir for storing toner and a rotatable developer roll positioned to transfer toner from the reservoir to the photoconductive drum;

an electrical connector positioned on the photoconductor unit on the first side of the housing, the electrical connector includes an electrical contact positioned within a pocket of the electrical connector that has an opening facing toward the front of the housing to permit a corresponding electrical connector of the image forming device to enter the pocket and contact the electrical contact when the replaceable imaging unit is installed in the image forming device; and a guide wall on the first side of the housing spaced toward the front of the housing from the opening of the pocket of the electrical connector, the guide wall is spaced higher than the electrical contact, at least a portion of the guide wall inclines rearward as the guide wall extends downward, the guide wall is unobstructed to contact the corresponding electrical connector of the image forming device during insertion of the replaceable imaging unit into the image forming device for aligning the corresponding electrical connector of the image forming device along a vertical dimension of the housing during insertion of the replaceable imaging unit into the image forming device.

2. The replaceable imaging unit of claim 1, wherein the guide wall is formed integrally with a frame of the photoconductor unit.

3. The replaceable imaging unit of claim 1, wherein the guide wall is spaced higher than the opening of the pocket of the electrical connector.

4. The replaceable imaging unit of claim 1, wherein the guide wall is positioned at a front end of the housing.

5. The replaceable imaging unit of claim 1, wherein the guide wall includes a flange that extends downward from the top of the housing and outward sideways from a portion of a frame of the photoconductor unit that forms a waste toner sump for storing toner removed from the surface of the photoconductive drum.

6. The replaceable imaging unit of claim 5, wherein the flange includes a first segment that is vertically oriented and a second segment that extends from a bottom of the first segment and that inclines rearward as the second segment extends downward.

7. The replaceable imaging unit of claim 1, further comprising a first drive coupler rotatably coupled to the photoconductive drum and a second drive coupler rotatably coupled to the developer roll, wherein the first and second drive couplers are exposed on the second side of the housing for mating with and receiving rotational motion from a corresponding first and second drive coupler, respectively, of the image forming device when the replaceable imaging unit is installed in the image forming device.

8. A replaceable imaging unit for use in an electrophotographic image forming device, comprising:

a housing having a top, a bottom, a front and a rear positioned between a first side and a second side of the housing, the housing includes:

a photoconductor unit positioned at the front of the housing, the photoconductor unit includes a rotatable photoconductive drum having a rotational axis that extends from the first side of the housing to the second side of the housing; and a developer unit positioned rearward from the photoconductor unit, the developer unit includes a reservoir for storing toner and a rotatable developer roll positioned to transfer toner from the reservoir to the photoconductive drum;

an electrical connector positioned on the photoconductor unit on the first side of the housing, the electrical connector includes an electrical contact positioned within a pocket of the electrical connector that has an opening facing toward the front of the housing to permit a corresponding electrical connector of the image forming device to enter the pocket and contact the electrical contact when the replaceable imaging unit is installed in the image forming device, a longitudinal dimension of the pocket is primarily vertical; and a guide wall on the first side of the housing spaced toward the front of the housing from the opening of the pocket of the electrical connector, the guide wall is spaced higher than the electrical contact, at least a portion of the guide wall inclines rearward as the guide wall extends downward along the longitudinal dimension of the pocket, the guide wall is positioned to contact the corresponding electrical connector of the image forming device during insertion of the replaceable imaging unit into the image forming device for aligning the corresponding electrical connector of the image forming device along the longitudinal dimension of the pocket during insertion of the replaceable imaging unit into the image forming device.

9. The replaceable imaging unit of claim 8, wherein the guide wall is formed integrally with a frame of the photoconductor unit.

10. The replaceable imaging unit of claim 8, wherein the guide wall is spaced higher than the opening of the pocket of the electrical connector.

11. The replaceable imaging unit of claim 8, wherein the guide wall is positioned at a front end of the housing.

12. The replaceable imaging unit of claim 8, wherein the guide wall includes a flange that extends downward from the top of the housing and outward sideways from a portion of a frame of the photoconductor unit that forms a waste toner sump for storing toner removed from the surface of the photoconductive drum.

13. The replaceable imaging unit of claim 12, wherein the flange includes a first segment that is vertically oriented and a second segment that extends from a bottom of the first segment and that inclines rearward as the second segment extends downward along the longitudinal dimension of the pocket.

14. The replaceable imaging unit of claim 8, further comprising a first drive coupler rotatably coupled to the photoconductive drum and a second drive coupler rotatably coupled to the developer roll, wherein the first and second drive couplers are exposed on the second side of the housing for mating with and receiving rotational motion from a corresponding first and second drive coupler, respectively, of the image forming device when the replaceable imaging unit is installed in the image forming device.

* * * * *